US006843037B2

(12) United States Patent
Nolfi, Jr.

(10) Patent No.: US 6,843,037 B2
(45) Date of Patent: Jan. 18, 2005

(54) TEMPERATURE COORDINATED THROUGH-LINE FOOD PACKAGING SYSTEM

(75) Inventor: Frank V. Nolfi, Jr., Ormond Beach, FL (US)

(73) Assignee: Conagra Grocery Products Company, Irvine, CA (US)

( * ) Notice: Subject to any disclaimer, the term of this patent is extended or adjusted under 35 U.S.C. 154(b) by 0 days.

(21) Appl. No.: 10/328,899

(22) Filed: Dec. 23, 2002

(65) Prior Publication Data

US 2003/0113414 A1 Jun. 19, 2003

Related U.S. Application Data

(63) Continuation of application No. 09/575,937, filed on May 23, 2000, now Pat. No. 6,557,319.
(60) Provisional application No. 60/156,343, filed on Sep. 27, 1999.

(51) Int. Cl.[7] ..... B65B 63/08
(52) U.S. Cl. ..... 53/127; 53/167; 53/425
(58) Field of Search ..... 53/425, 426, 440, 53/127, 167; 426/399, 401, 407, 412, 521

(56) References Cited

U.S. PATENT DOCUMENTS

| | | | | | |
|---|---|---|---|---|---|
| 3,891,779 | A | * | 6/1975 | Robinson | 426/399 |
| 3,970,763 | A | * | 7/1976 | Moran et al. | 426/399 |
| 3,972,153 | A | * | 8/1976 | Kiellarson et al. | 53/426 |
| 4,059,919 | A | * | 11/1977 | Green | 426/521 |
| 4,503,656 | A | * | 3/1985 | Hautemont | 53/425 |
| 4,533,289 | A | | 8/1985 | Guzdar | 414/217 |
| 4,637,936 | A | * | 1/1987 | White et al. | 426/521 |
| 4,867,994 | A | * | 9/1989 | Perrine | 426/399 |
| 5,071,667 | A | * | 12/1991 | Grune et al. | 53/425 |
| 5,080,164 | A | | 1/1992 | Hermans | 165/2 |
| 5,195,298 | A | * | 3/1993 | Baranowski | 53/425 |
| 5,229,154 | A | * | 7/1993 | Street | 426/399 |
| 5,269,216 | A | * | 12/1993 | Corominas | 53/425 |
| 5,281,431 | A | * | 1/1994 | Dunckel | 426/399 |
| 5,422,130 | A | | 6/1995 | Fox et al. | 426/234 |
| 5,843,501 | A | | 12/1998 | Rubin et al. | 426/127 |
| 5,895,626 | A | * | 4/1999 | Nakata et al. | 426/399 |

FOREIGN PATENT DOCUMENTS

| | | |
|---|---|---|
| WO | WO9940384 | 8/1999 |

* cited by examiner

*Primary Examiner*—Louis Huynh
(74) *Attorney, Agent, or Firm*—Nutter McClennen & Fish LLP

(57) ABSTRACT

A food packaging system wherein one or more food component preparation lines deliver heated, e.g., cooked, components to a packaging station that operates at overpressure to maintain aseptic conditions as a container is filled and sealed. The preparation line may be a high pressure heated conduit, a covered batch conveyer, sealed pocket feeder or similar line, and prepares each component at a temperature and time suitable for the particular ingredient. Plural separate preparation lines may deliver different food components to the pressure chamber in which filling occurs, and each component attains a narrowly-defined degree of cooking or uniform stage of undercooking. A loading lock interfaces the packaging and preparation sections so as to prevent evaporative fluid loss or cooling and preserve aseptic conditions during filling and sealing. The sealed containers may be heated or held in a sterilizing chamber for a brief time, after which they may be cooled, labeled and placed on or in pallets or cartons for shipping or storage. The food preparation lines (if more than one) may be configured to specifically perform cooking a different food component in each line before packaging. When a segmented flow preparation line is used, the segmenting elements may operate as pressure seals to deliver successive batches into the packaging station. For other lines, an entry chamber may include one or more load locks to transfer cooked food components into the station for packaging, and dosing pumps or robotic handlers may apportion, assemble or package the various components. The system extends the range of heat-sensitive food components, and of heat-sensitive packaging materials that may be used, providing a higher quality product.

12 Claims, 5 Drawing Sheets

TEMPERATURE COORDINATED THROUGH-LINE FOOD PACKAGING SYSTEM

CROSS-REFERENCE TO RELATED APPLICATIONS

This application is a continuation of U.S. patent application Ser. No. 09/575,937, filed on May 23, 2000, now U.S. Pat. No. 6,557,319, which claims priority to U.S. Provisional Patent Application No. 60/156,343, filed on Sep. 27, 1999, the contents of which are incorporated herein by reference.

BACKGROUND OF THE INVENTION

The present invention relates to the field of food packaging, and particularly to the preparation of sealed containers of mixed or heterogeneous food products.

In general, when food products, other than staples and dried foods, are to be packaged for long term storage, they are placed in sealed containers such as cans, sealed foil trays or pouches, or multi-layer paper/polymer/foil packages. These are sealed against the atmosphere and may additionally provide a relatively strong structure (in the case of canned goods) suitable for handling and storage at room temperature, for example, on shelves or bins for extended periods of time, or suitable for cold storage. Such sealed containers must be sterile, and current industry practice, particularly in the United States, involves heat sterilization.

The level of applied heat, that is the pressure, temperature, heating medium and duration of heating, may vary depending on the conditions under which processing or cooking of the ingredients, the filling of the packages and the sealing operation have been carried out. For canned goods, post-sealing retorting of the cans is commonly employed. This involves maintaining the entire sealed can at a temperature above a specified sterilizing temperature for a time sufficient to heat the can and every portion of its contents to the sterilizing temperature. Typically the processing or retort temperature is substantially above normal boiling temperature, and the process may be carried out at elevated pressure to prevent rupture or ballooning of the container. Similar sterilization processing is used for foil-sealed freezer products. Certain earlier stages of food processing also employ elevated pressure and temperature, where the pressure elevation serves the further advantage of preventing evaporative cooling or moisture loss during the heating involved in such cooking, sealing or packaging phases. By way of example, U.S. Pat. No. 5,422,130 illustrates a process wherein a packaging apparatus maintains an elevated pressure to minimize evaporation, and various load locks are used to provide a stepped cool-down and pressure reduction cycle for relieving packaging stresses.

Retorting is cheap and effective. This makes it especially suited to process lines wherein the earlier stages of cooking and assembling the product are carried out under non-aseptic conditions. Non-aseptic processing followed by packaging and retorting allows normal factory assembly lines with human operators to conveniently carry out tasks required for cooking, assembling and filling products such as packaged meals, where the assembly may involve steps such as trimming or arranging components of the meal in positions on a tray, and performing decorating steps or checking their quality before the package is sealed. However, in these cases where the food product is assembled from several components at cooler temperatures, the entire unit must be sterilized, and required sterilization time for the entire packaged product may be quite long. The quality of the various cooked, parboiled, simmered or otherwise fully or partially processed components of the product may deteriorate upon exposure to the high sterilization temperatures when these are maintained for such lengthy sterilization times. Indeed, the stringent conditions of retort sterilization alone may overcook a number of component ingredients. This is also a problem for the basic processing of food products involving large solids, which require lengthy heating to attain a sterilization temperature. Lengthy heating also limits the types and materials of packaging that may be used.

When cost is not a driving consideration, it is possible to address these concerns, for example, by providing a final filling line in a high pressure environment, in which the human operators enter a high pressure chamber where food product components may be maintained at a high temperature without undergoing evaporative cooling, and the operators may then perform all preparation and assembly tasks up to the filling and sealing steps while the ingredients are maintained above a threshold level at which resterilization does not become necessary. In this case, the packaged goods may require only a brief heated holding cycle, or a shorter time retort to achieve sterility, rather than reheating the entire contents of the packages.

However, such elaborate pressurized processing facilities can only be justified in the case of a few high-priced products such as luxury frozen meals. The vast majority of packaged foods involve more mundane products, such as stews containing heterogeneous size chunks of meat or potato, products involving pieces of one or more fruits or vegetables of differing but relatively large size, and other materials which either because of their size, or because they include a fragile or heat sensitive product component, render it difficult to arrange for cooking, filling and for sterilization regimes that do not degrade or interfere with one or more of the solids or other components such as sauces, vegetables or toppings that make up the packaged food product. Even for some simple single-ingredient or substantially homogeneous products, like canned peas, the basic retorting cycle may exceed the required cooking cycle, or may result in a product which is necessarily overcooked, or is mushy, or else requires compensatory use of under-ripe starting produce or addition of flavor-enhanced liquid fractions. A basic problem in the preparation of such products is that the cumulative heating involved in all stages of processing degrades the quality of one or more components of the product.

Accordingly, it would be desirable to provide an enhanced food packaging system that achieves sterilization without impairing food texture or taste.

It would further be desirable to provide a food packaging system capable of fast sterilization.

It would also be desirable to provide a packaging system in a process line that coordinates processing, filling, sealing and sterilization to produce sterile, storable packages of tasty food.

SUMMARY OF THE INVENTION

One or more of the foregoing ends are achieved in accordance with the present invention by providing a food processing and packaging system wherein one or more ingredient or food component heat preparation lines feed to a common package filling station that operates at elevated pressure and temperature to maintain aseptic conditions as a container of food product is filled and sealed. Each preparation line such as, for example, a high pressure heated conduit, a covered and heated batch conveyer, or other similar line, prepares its food component at a sterilization temperature cycle and time suitable for the particular ingredient, and the preparation lines converge to a packaging station where the food portions arrive fully sterilized at elevated temperature and enter a pressure chamber in which filling occurs. The elevated pressure of the chamber prevents evaporation so the foods making up the product remain near or above the sterilizing temperature, or within the temperature band considered aseptic, during the entire filling and sealing operation. A pressure of 18 psi may be sufficient. Off-line, a supply of packages or package material is provided to the packaging station, preferably in a sterile condition, and may be briefly heated prior to filling and sealing. Optionally, sterile packages or packaging material may be heated solely by contact with the heated product upon filling, and the sealed containers may be held for a brief time if necessary after which they are cooled, labeled and placed in suitable shipping containers, pallets or cartons. The system contemplates that cold sterilization procedures such as irradiation or gas sterilization may be employed for the packaging, so that foils, polymers and packaging materials that cannot sustain prolonged heating may be advantageously used in the present invention to afford new packaging possibilities.

Each of the food preparation lines (if more than one) is configured to perform essentially all cooking treatment of the food component traveling in that line before reaching the packaging station and to attain a sterile temperature level. The food components may be divided generally into various categories such as ones with critical cooking times (e.g., delicate ingredients such as small pieces of fruit or vegetable) or non-critical cooking times (e.g., certain syrups or sauces) and the components may further be characterized, for example, as large solids requiring lengthy controlled heating to a defined inner temperature (as is done for chunks or portions of meat, vegetable or potato) or substantially homogenous smaller pieces which may cook through as they flow with surrounding fluids through a relatively short bulk heating conduit or heated holding line.

To the extent that different food components have conflicting cooking or heating requirements, these are placed in different processing lines or enter at different stages of one line, en route to the packaging station. Cooking may also be addressed by means, such as those shown in U.S. Pat. No. 5,080,164, (which employs flow obstructions of graded sizes to allow processing of components with different cooking requirements in a single heated flow line by assuring that larger objects remain in the heating conduit for longer times) or otherwise, to assure that each size component achieves a degree of cooking or heat distribution suitable for that component. Alternately, the front end cooking for this process achieved in the product component delivery lines may also be addressed by certain batch or segmented flow processing systems, which isolate each ingredient in a well-defined heated cooking path for a period of time sufficient to uniformly cook, but not overcook, that component so that its degree of cooking and its final temperature both fall into a specified narrow range. Also, more than one such segmented batch or processing line may run in parallel, at different rates and temperatures, joining at process line branch points. In such a case, the infeed line may have a complex architecture, with one or more larger components being delayed in a recirculation loop, and batches passing through at controlled times or intervals, along the conduit to the packaging station for packaging, or prior to combining and packaging the various ingredients having different or incompatible cooking requirements.

However, in accordance with the present invention, all components of the food to be packaged are delivered at elevated temperature and fully sterilized to the packaging station, which itself is at an elevated temperature/pressure, so that packaging occurs without temperature drop and is effected under aseptic conditions. Further heating, if any, required for sterilization under applicable processing schedules may then be effected quickly, and may typically be limited to the time required for washing and holding the package itself, rather than reheating its contents.

BRIEF DESCRIPTION OF THE DRAWINGS

These and other features of the invention will be understood from the description below taken in conjunction with the figures showing illustrative embodiments of the invention, wherein.

DETAILED DESCRIPTION

Figure 1:
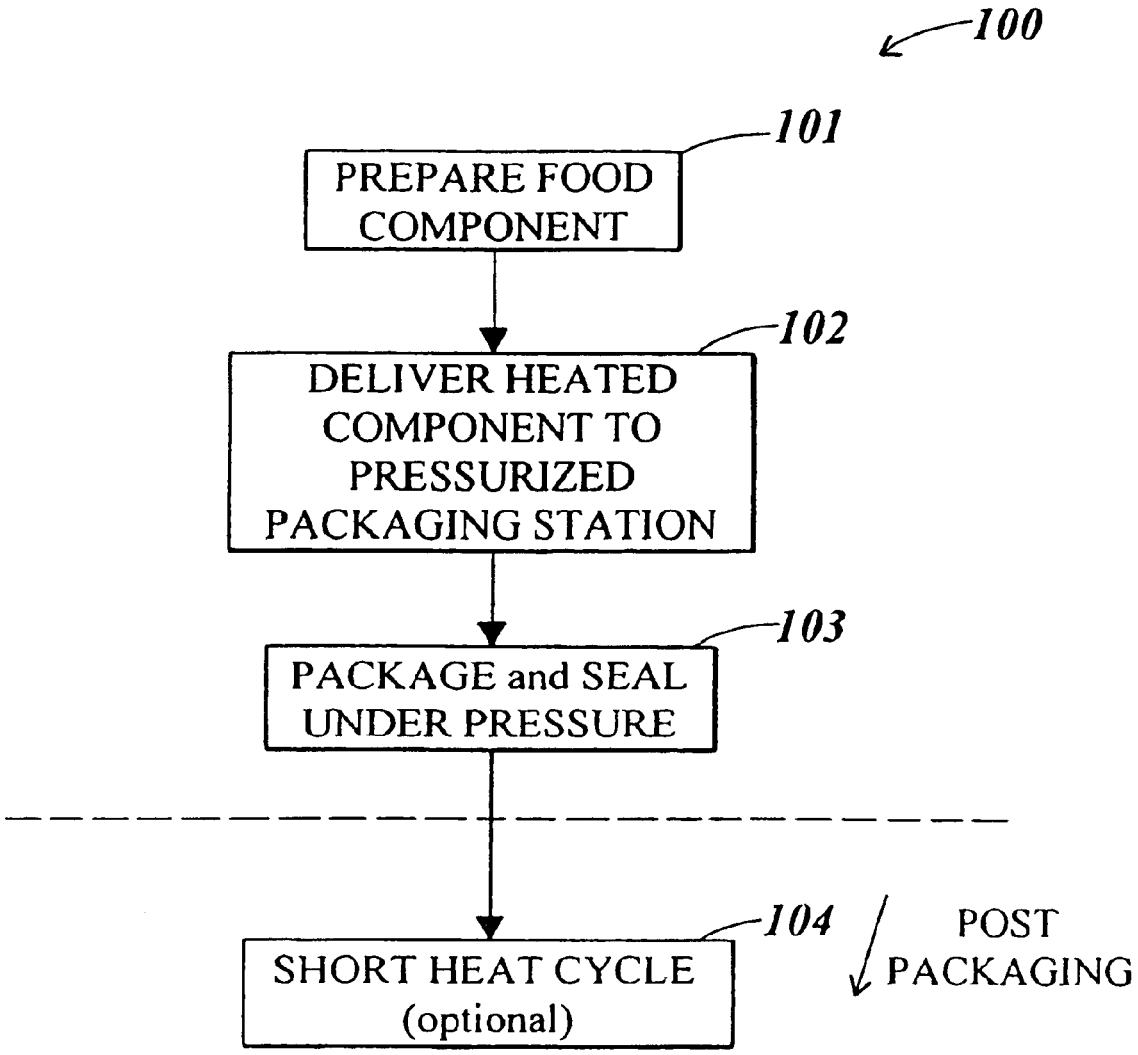
FIG. 1 illustrates the packaging method of the present invention.

FIG. 1 is a flow chart showing basic steps of the method 100 of food processing and packaging of the present invention. As shown, method 100 includes the step 101 of preparing a food component and the step 102 of delivering the heated component to a pressurized packaging system. This may be effected by a pressurized load lock or a sealed flow connection. The packaging station then packages and seals the component in containers, such as trays or cans, while maintaining pressure during a packaging step 103. In general, by pressurized, applicant means at a pressure at least several psi above atmospheric pressure, and the effect is therefore to raise the boiling point of the food and/or water such that the food which has entered the packaging station remains well above 100° C. and undergoes limited or minimal water loss, evaporative cooling, or temperature drop. Where the processing line is itself at elevated pressure, the pressures of the line and the station may be matched to avoid backflow or adiabatic cooling events, or they may be interfaced by one or more sterile vented locks. Thus the food components are aseptic throughout the packaging process. Preferably the packaging station, together with the packages/seals utilized therein, is at a suitably elevated temperature (e.g. 255° F.) so that no additional heating is needed under applicable food sterilization regulations. However, optionally, a post packaging heated or heat-controlled holding step 104 may be provided if necessary prior to cool-down, labeling and shipping or storing.

By "preparing" a food component, applicant means heating a food component to a sterile temperature, and cooking or at least partially cooking the component. It will be understood that in general, when foods are packaged under non-aseptic conditions, proper sterilization may require lengthy post-packaging retorting or heating. As a compensatory measure, foods packaged non-aseptically may be intentionally undercooked in order to complete their cooking during sterilization. A drawback when such lengthy post-packaging sterilization is required, is that all components of the food product are subjected to the same heating, which may be excessive for some components.

In accordance with the present invention, however, the food entering the packaging station is prepared such that time spent in the packaging station and any post-package heating is to be very short. Preferably, the prepared food components entering the packaging station are to be fully cooked, or are underdone by only a small amount corresponding to the residence time in the packaging station and residual heating, and holding if any, before cool down is effected. When several components are provided to the packaging station from different component processing lines, or are combined from different cooking segments and/or loops prior to entry of the packaging station, all components are substantially cooked, or else all are substantially equally underdone. Preferably, very precise cooking control is effected by employing segmented, traveling batch, or graded flow obstruction continuous flow for the food component heating lines, as described further below.

Figure 2:
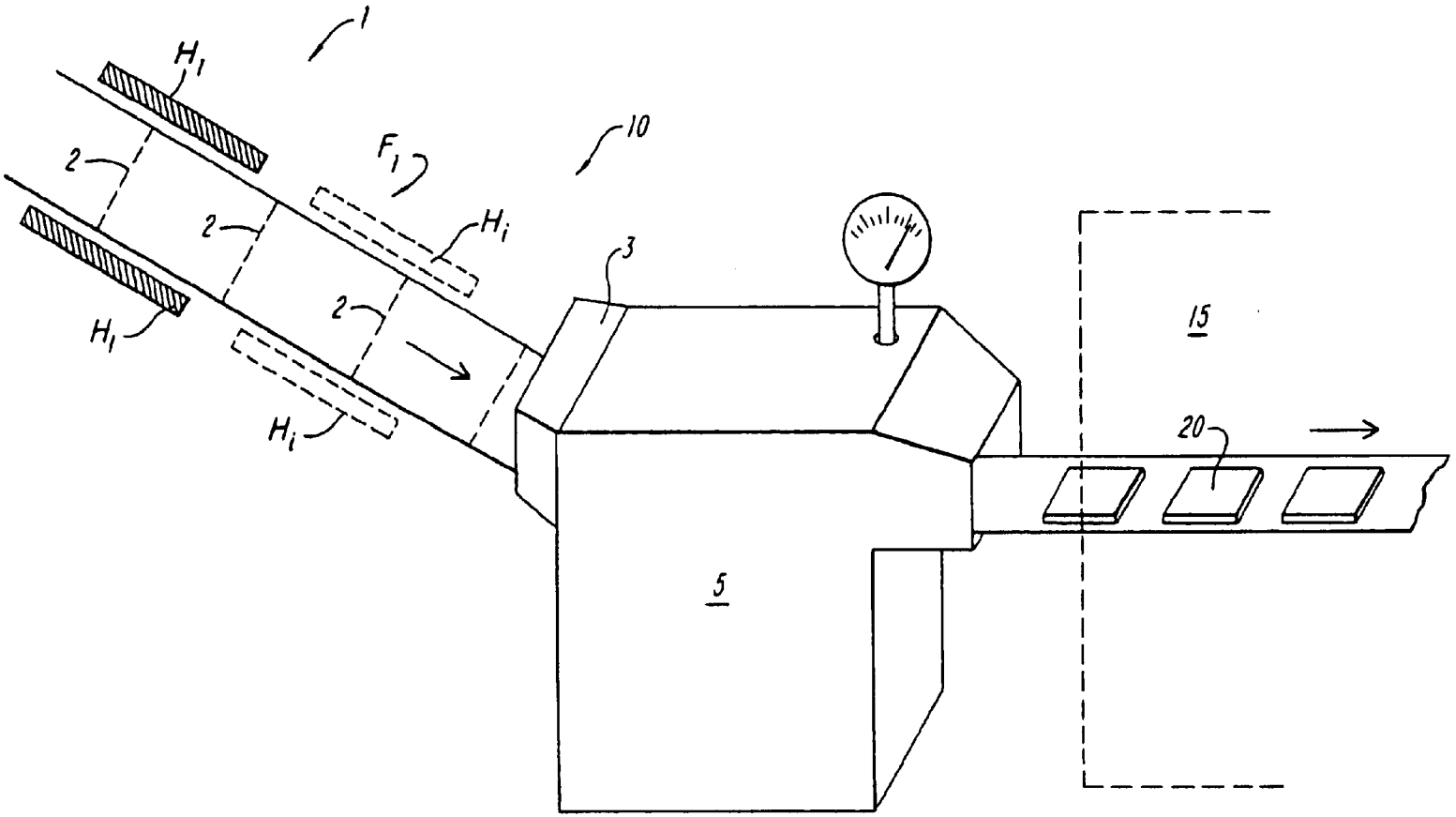
FIG. 2 illustrates a representative packaging line.

FIG. 2 illustrates a basic embodiment of a food packaging system 10 in accordance with the present invention. As shown, the system includes a food processing line which may illustratively comprise one or more heated conduits or conveyors 1, and a packaging station 5. The packaging station may, for example, be an automated mechanical assembly for loading and sealing cans or other packages, and according to the present invention the packaging station 5 is sterile, and is maintained at an overpressure P which both prevents contamination from leaks and effectively prevents food components that have entered the station from undergoing evaporative cooling. Preferably station 5 is maintained at a temperature of 255° F. and a pressure above about 18 psi. Food passes from the processing line 1 through an entry assembly 3 into the pressurized station 5. Station 5 also contains, or receives, packages or package-forming material, and includes a suitable mechanism, which may be conventional, for filling and sealing the packages.

While not illustrated, it will be understood that the package forming material may be a material such as bulk metal, foil or polymer sheet which may for example be provided in blanks or rolls that may be stored and shaped within, and are filled and sealed within, the packaging station 5. Alternatively, separate container-conveying lines may provide preformed containers such as glass containers or metal containers to the packaging station 5. The containers are sterilized by heat exhausting, mechanical exhausting, hot brining, steam injection or the like prior to or upon entry into the packaging station.

Within the processing line 1, food is processed—e.g., cooked or heated with one or more heaters or heat exchangers $H_1$, $H_i$ arranged so that the component food $F_1$ enters at a first end 1*a* and the processed food is brought to an elevated temperature and is sterile as it exits the second end 1*b* to enter the packaging station. As further shown in FIG. 2, the processing line 1 preferably is configured as a continuously moving conveyor, or as a flow within a conduit, that operates with dividers or separation barriers 2 spaced along the line 1 so that the food component remains within a narrow fixed subdivided chamber or bin as it travels. Its residence time is thus precisely determined by the conveyor speed or conduit flow rate, and the temperature in each segment, so that the food component is therefore cooked or heated to an accurately defined degree of sterilization before reaching the exit end 1*b* of the line.

The processing line 1 need not operate at high pressure, nor need it operate at a uniform temperature, so long as its temperature distribution is known. Typically, heat may be provided by one or more surrounding ovens, steam jackets or the like. Preferably the food components in the line attain a sterile temperature by the time they arrive at the exit end 1*b*, and most preferably the pressure and temperature are both elevated to a sterilizing range around 255° F. at least in the final divider sub-chamber arriving at end 1*b*, or else are heated to a somewhat lower but sterile temperature and do not decrease in temperature in the entry station 3.

The entry station 3 is thus configured to permit pressurized entry of a batch or quantity of food from the line 1 into the pressurized packaging station 5. Entry station 3 may be implemented as a heated, pressurizable load lock, and may further be incorporated into the exit end 1*b* of the processing line 1, for example, by configuring the exit region 1*b* to form a pressure seal between the outside of the conduit or line, and the traveling barriers 2. This may be accomplished by, for example, arranging the batch process line 1 like a linear pocket feeder in which the dividers 2 are, for example, formed by pistons that slide within the heated processing conduit, and configuring the end of the line to include some means for adjusting the diameter of the interior of the tubular path to form temporary pressure seals about successive dividers as each segment's batch of the cooked food component is passed into the packaging station 5. By way of example, the sliding seals and flow heating arrangement shown in U.S. Pat. No. 4,533,289 may be applied to form such a pressure-lock end segment of the segmented processing line 1.

While FIG. 2 illustrates a single processing line 1, the invention contemplates that several such lines may all converge to the station 5. Furthermore, the entry station or lock 3 may be configured with valves and/or a manifold to receive product inputs from all the lines either successively, or simultaneously. This is especially useful when plural food components are to be packaged in the same package. The actual form of the entry station 3 and packaging station 5 may vary, depending upon the particular food components and their mode of transport, and may for example include one or more flow conduit connections, pressurized steam inlets for driving or unloading the flow, and one or more conveyor belts, or dosing pumps for liquid-based foods, or discrete robotic product handling segments, so as to receive and transport heated batches of the respective food components into the packaging station 5, to place the correct amount or arrangement of each component in the package, and seal the package.

Thus, each preparation line such as, for example, a high pressure heated conduit, a covered batch conveyer or similar line, prepares its ingredient at a temperature and time suitable for the particular ingredient, and the preparation lines converge to a packaging station where the prepared food components, having attained a high temperature, and preferably also an elevated pressure, enter a pressure chamber in which filling of the cans or packages 20 occurs. The pressure is adequate to prevent influx of non-sterile air from the atmosphere and limits evaporation while the foods making up the product remain near or above a required sterilizing temperature during filling and sealing. The sealed containers 20 are then preferably held in a sterilizing chamber for a brief time, after which they are cooled, labeled and placed in their shipping container such as on a pallet or in a carton. The cans or packages 20 are sterile, which for certain packaging material may be effected by gas sterilization or other cold process, or they may be heated before packaging occurs. In addition, packages may be passively heated by the hot food components or be heated in the station 5, or may be heated separately in an exit oven or retort for a relatively brief time. In the case of foil tray freezer packages, for example, once packaged they may pass to a flash freezer 15 to cool down before labeling and packing in cartons.

Applicant envisages that by employing a segmented travel cooking line, an exact degree of done-ness or under-doneness may be achieved within a very narrow tolerance for each food component, so that the pre-packaging heating plus the packaging heating results in a packaged product that remains or becomes precisely or fully cooked, and is also sterile. The only constraint is that in accordance with the present invention, all components of the packaged food are delivered from line 1 at elevated temperature to the aseptic and pressurized packaging station 5 so that the total process proceeds under aseptic conditions, and final sterilization time is low. For example, the package may be sterilized in under one minute, and food may be packaged such that the amount of additional heating at packaging is effectively limited to heating the package itself, rather than its contents. When sterilized packaging is supplied to the packaging station, cool-down may begin immediately when the product has been fully cooked, or when additional cooking is necessary, it may proceed by thermal diffusion within the already-heated product. In this case, the further heating may be effected simply by utilizing a controlled-cooldown holding time, or providing a small additional amount of heat to limit the rate of post-packaging temperature drop. Prior to the packaging and sealing stage, the packaging may be sterilized offline, and may be sterilized by non-thermal means, such as an ozone wash or exposure to radiation. This allows heat-sensitive packaging materials to be employed for products or packaged foods where harsh sterilization conditions would otherwise prevent their use. Thus, by providing a process line wherein batch or segmented flow product is passed, or is combined and then passed, directly to a pressurized aseptic packaging station, all aspects of cooking are exactly controlled, and the remaining level of heating required for sterilization does not degrade the taste or texture of fragile or heterogeneous foods, or the physical properties of the package.

This arrangement of processing and packaging steps allows new combinations of foods to be processed and packaged together in a manner that produces a high quality product. For example, small fragile components such as peas may be processed to limit cooking while reaching aseptic conditions immediately prior to packaging, while larger components may be processed in a separate longer line to achieve substantially complete cooking while arriving at a high temperature. Other components such as sauces which may be of stable quality at high temperatures for extended times may reside in a pressurized feed conduit. When combined in the pressurized packaging station, the more fragile ingredients may complete their cooking in the package or during the internal heat transfer prior to and during post packaging cool-down, while no substantial additional heat is added to any of the ingredients.

Figure 3:
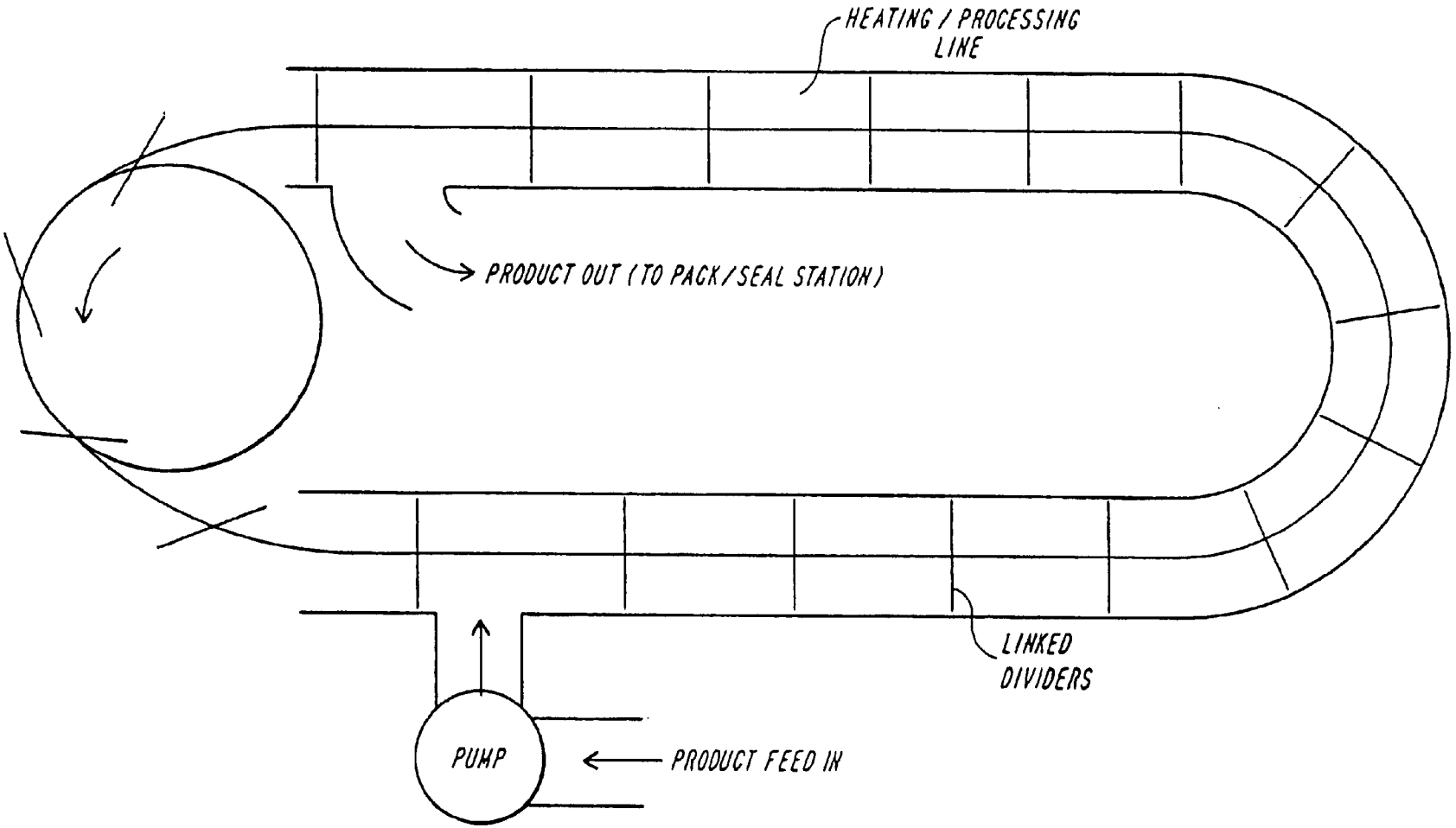
FIG. 3 illustrates a representative food processing line suitable for the front end of the line of FIG. 2.

FIG. 3 illustrates a representative segmented travel process line. Implementation of such lines for fluid flows are discussed more fully in the above-mentioned U.S. Pat. No. 4,533,289, and in the published international patent application PCT US/99 02730 entitled Segmented Flow Device. The food component line may include one or more pumps, holding sections, or intermediate feed inlets in addition to dividers in the processing line. Furthermore, the dividers may be linked, or may be effected by using freely circulating spacers such as large plastic spheres to define batch boundaries and prevent irregular forward-or back-flow.

As briefly indicated above, the present invention also contemplates embodiments wherein the food processing line has a more complex construction, in which several different food components are processed and combined in a single line ahead of the packaging station 5. One such food cooking process line is shown schematically in FIG. 3A. As shown in that figure, an input food processing line 21 may include plural segments 22, 23, 24, 25 which connect together at branch point or in series, with different food components being injected under pressure into the line at different stages thereof. This may typically be effected by selectively opening and closing valves leading to sterile pressure sources, reservoirs of food component, and vents to fill, transport or flush the contents of segments of the conduit.

Figure 3A:
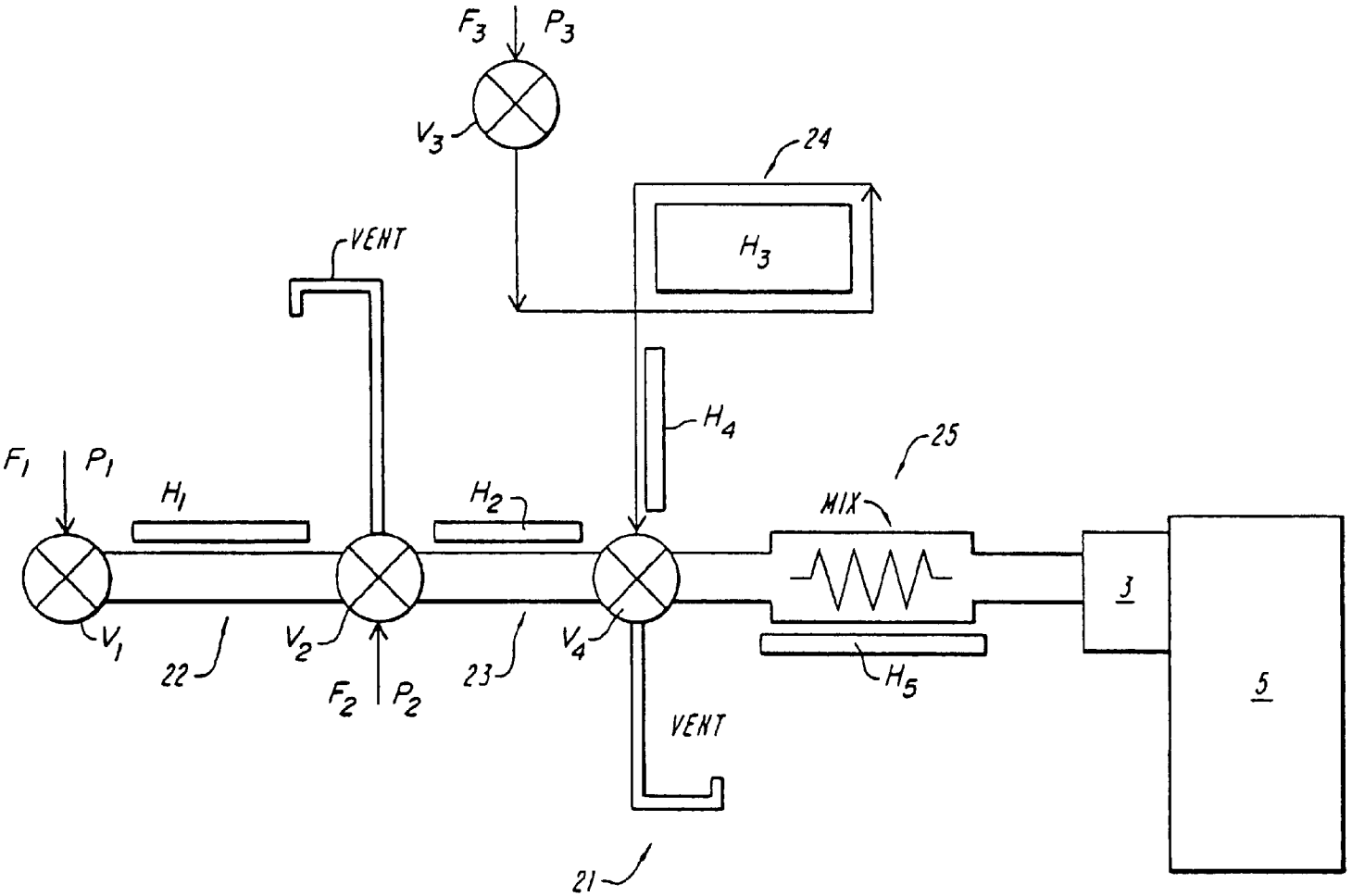
FIG. 3A illustrates another food processing line suitable for the front end of the line of FIG. 2.

Thus, for example, as shown in FIG. 3A, a first food product $F_1$ at pressure $P_1$ enters through a valve $V_1$ or other input/output configuration to the initial heated processing segment 22. A second food component $F_2$ enters through a similar inlet/outlet section, again represented schematically as a valve $V_2$ to join the first component in traveling along heated processing segment 23. The inlet/outlet stations may be implemented with dividers similar to those shown in the aforesaid international patent application, or those illustrated in FIG. 3, or may be otherwise implemented by providing suitable sets of valves and steam or pressure sterile sources for driving a component into a container, evacuating a segment of pipe and venting it, receiving a second component and driving them along. Continuing with the description of FIG. 3A, a third food component $F_3$ enters a branch segment 24 shown as an extended heated loop with heaters $H_3$, $H_4$ to heat that component for a time and at a rate effective to achieve a suitable degree of cooking and sterilization before entry at a third input/output valve segment $V_3$. The combined substantially processed food components pass to a mixing chamber or segment 25 where they are non-destructively mixed to provide a substantially homogeneous but multi-component food product at the inlet 3 of the packaging station 5. It will be understood that the schematic illustration is simplified, in that each of the inlet/outlet portions may require several valves or intermediate conduit sections which can be flushed, vented and then opened to new product while preserving sterility of the enclosed flow path defined by the conduits valves and pressure/vent sources. Further, the various branch conduits may be of different sizes to allow appropriate flow volumes and rates of cooking to be achieved for the amounts of each component entering the final mix. This provision of a branched inlet flow line rather than separate inlet lines to the packaging station 5 may be preferred in situations where the packaged product itself is a liquid and where sedimentation or separation of the components during passage through the processing line 21 does not arise. In each case, as discussed above for the basic embodiment of the invention, the food product entering the packaging station 5 at inlet 3 is pressurized, heated to a substantial level, and has undergone substantially all, or a controlled or preferably uniform partial level of the required heating necessary for its cooking and sterilization under applicable process schedules for food of that type.

Figure 4:
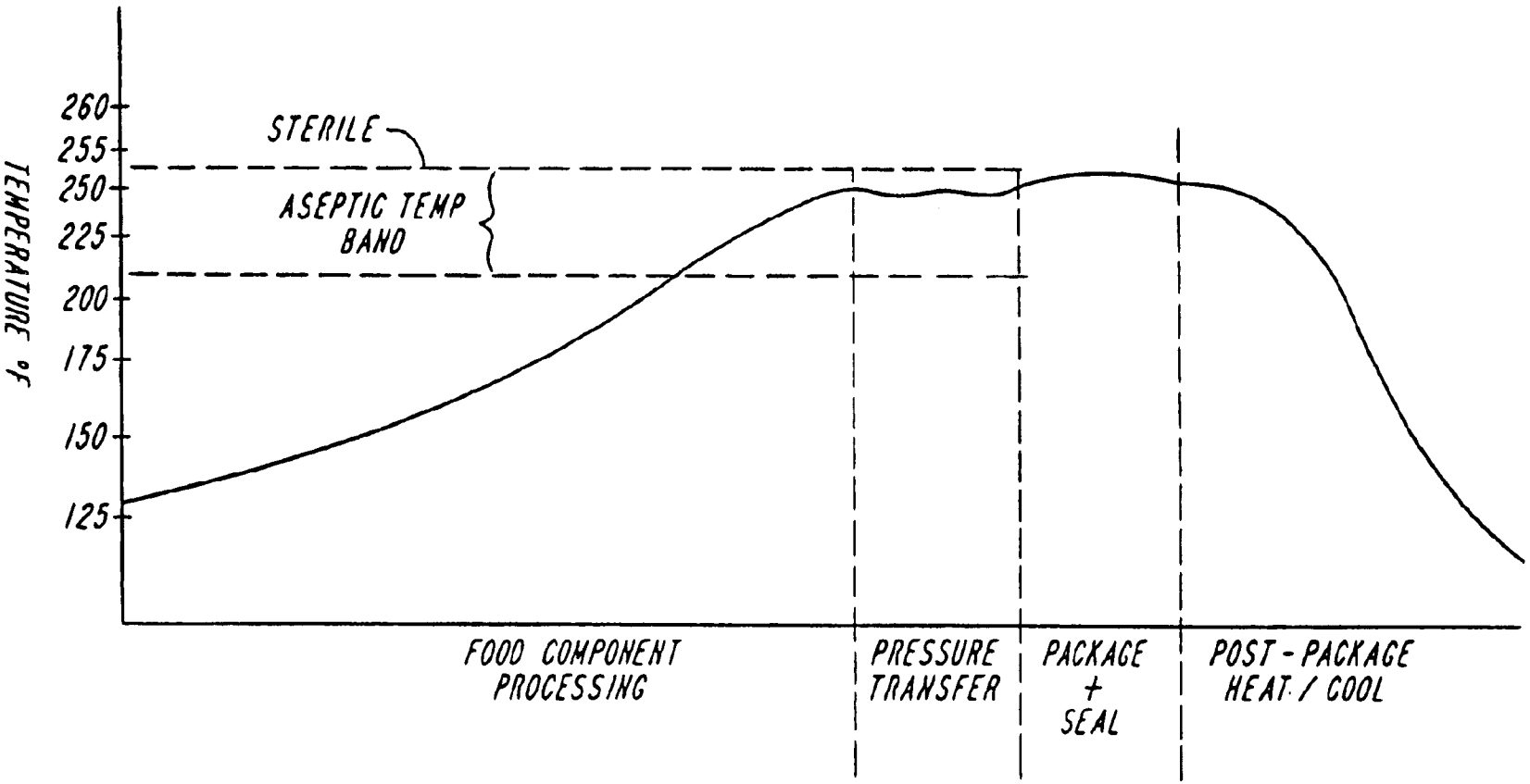
FIG. 4 shows representative temperature at the various stages of the packaging line of FIG. 2.

FIG. 4 illustrates representative temperature as food components pass along the preparation line 1, loading lock 3 and packaging station 5. In FIG. 4 the temperature curve describes the temperature of the slowest heating point (typically the geometric center of a pipe or can in conductive heating foods.) As shown, temperature rises during processing, and remains elevated between preparation and packaging, lying in an aseptic band above the level that would require re-processing or post-packaging sterilization, so that little, if any, additional heat is needed to assure sterility of the packaged product, and cool-down may be effected very quickly after packaging.

The invention being thus described, further variations and modifications will occur to those skilled in the art, and all such variations and modifications are considered to be within the scope of the invention, as defined herein and by the claims appended hereto and equivalents thereof.

What is claimed is:

1. A method of preparing and packaging a food product, wherein the product comprises a plurality of food components including at least one susceptible component subject to heat degradation from thermal processing, the method comprising the steps of:

providing a food preparation and packaging system having a food component preparation line comprising at least one controlled travel food processing line configured to heat process at least one of the plurality of food components to a precise degree of cooking and controlled temperature as the at least one food component travels along the preparation line, a pressurized aseptic packaging station, including a package handling, filling and sealing assembly for placing the food component in a package and sealing the package, and a holding stage operative to controllably cool the sealed package and pass it out of the system;

thermally processing at least one food component of the food product using the food component preparation line until essentially all cooking treatment of the at least one food component is performed, and so that the food product is a sterile food product that has attained a sterile temperature and condition;

delivering the sterile food product including the at least one thermally processed food component to the pressurized aseptic packaging station; and packaging and sealing the sterile food product in a sterile package without thermal degradation of the at least one susceptible component contained therein such that no additional heat is added to the sterile food product.

2. The method of claim 1, wherein the food component preparation line is configured to perform essentially all cooking treatment of the at least one food component traveling in the line before reaching the aseptic packaging station.

3. The method of claim 2, wherein the at least one food component attains a sterile temperature level before reaching the aseptic packaging station.

4. The method of claim 1, further including the step of maintaining the packaging station at an elevated pressure and temperature such that no additional heat is added.

5. The method of claim 1, further including the step of sterilizing the package prior to filling the package with the food product.

6. The method of claim 1, wherein the step of packaging the food product occurs under sterile conditions.

7. The method of claim 1, wherein the food component preparation line includes a segmented travel heating line to uniformly heat process the food component.

8. The method of claim 1, wherein the food component preparation line includes a multiple-conduit preparation line that substantially cooks or uniformly undercooks a plurality of different food components that have been packaged.

9. The method of claim 8, wherein the amount of thermal processing of each of the different food components is related to the length of time each food component spends traveling through the controlled travel food processing line.

10. The method of claim 1, wherein the amount of thermal processing of the at least one component is related to the length of time the at least one component spends traveling through the controlled travel food processing line.

11. The method of claim 1, wherein sterilization of the at least one component is dependent upon the length of time the at least one component spends traveling through the controlled travel food processing line.

12. A method of preparing and packaging a food product, wherein the product comprises a plurality of food components including at least one susceptible component subject to heat degradation from thermal processing, the method comprising the steps of:

providing a food preparation and packaging system having a food component preparation line comprising at least one controlled travel food processing line configured to heat process at least one of the plurality of food components to a precise degree of cooking and controlled temperature as the at least one food component travels along the preparation line, a pressurized aseptic packaging station, including a package handling, filling and sealing assembly for placing the food component in a package and sealing the package, and a holding stage operative to controllably cool the sealed package and pass it out of the system;

thermally processing at least one food component of the food product using the food component preparation line to achieve a sterile food product;

delivering the sterile food product including the at least one thermally processed food component to the pressurized aseptic packaging station; and packaging and sealing the sterile food product in a sterile package without thermal degradation of the at least one susceptible component contained therein such that no additional heat is added to the sterile food product;

wherein the amount of thermal processing of the at least one component is related to the length of time the at least one component spends traveling through the controlled travel food processing line.

* * * * *